US010219625B2

(12) United States Patent
Probst et al.

(10) Patent No.: US 10,219,625 B2
(45) Date of Patent: Mar. 5, 2019

(54) PIECE OF FURNITURE AND ADJUSTING ASSEMBLY, IN PARTICULAR FOR ADJUSTING A BACK OF A CHAIR

(71) Applicant: Stabilus GmbH, Koblenz (DE)

(72) Inventors: Ulrich Probst, Koblenz (DE); Lars Löhken, Koblenz (DE); Raphael Piroth, Koblenz (DE); Markus Müller, Koblenz (DE); Fred Häring, Koblenz (DE)

(73) Assignee: Stabilus GmbH, Koblenz (DE)

( * ) Notice: Subject to any disclaimer, the term of this patent is extended or adjusted under 35 U.S.C. 154(b) by 200 days.

(21) Appl. No.: 15/219,551

(22) Filed: Jul. 26, 2016

(65) Prior Publication Data

US 2017/0027325 A1 Feb. 2, 2017

(30) Foreign Application Priority Data

Jul. 28, 2015 (DE) ..... 10 2015 214 301

(51) Int. Cl.

| | |
|---|---|
| ***A47C 3/20*** | (2006.01) |
| ***A47C 3/24*** | (2006.01) |
| ***A47C 1/03*** | (2006.01) |
| ***A47C 1/024*** | (2006.01) |
| ***A47C 7/54*** | (2006.01) |
| ***A47C 7/40*** | (2006.01) |
| ***A47B 9/00*** | (2006.01) |

(52) U.S. Cl.

CPC ..... *A47C 3/20* (2013.01); *A47B 9/00* (2013.01); *A47C 1/0242* (2013.01); *A47C 1/03* (2013.01); *A47C 3/24* (2013.01); *A47C 7/402* (2013.01); *A47C 7/54* (2013.01); *A47B 2200/0056* (2013.01); *A47B 2200/0062* (2013.01)

(58) Field of Classification Search

CPC ..... A47C 3/20; A47C 1/0242; A47C 1/024; B60N 2/0224; B60N 2/0232; B60N 2002/024; B60N 2002/0236

See application file for complete search history.

(56) References Cited

U.S. PATENT DOCUMENTS

| | | | | |
|---|---|---|---|---|
| 4,094,024 | A | 6/1978 | Benoit et al. | |
| 5,063,623 | A * | 11/1991 | Bathrick | A47C 20/041 5/616 |
| 6,629,731 | B2 * | 10/2003 | Rogers | A47C 1/023 297/330 |
| 2006/0075558 | A1 * | 4/2006 | Lambarth | A61G 1/0212 5/611 |

FOREIGN PATENT DOCUMENTS

| | | |
|---|---|---|
| DE | 10127306 | 12/2002 |
| DE | 20210187 | 12/2003 |

OTHER PUBLICATIONS

German Search Report of DE 10 2015 214 301.5 dated Mar. 16, 2015, 9 pages.

* cited by examiner

*Primary Examiner* — David R Dunn
*Assistant Examiner* — Tania Abraham
(74) *Attorney, Agent, or Firm* — Rankin, Hill & Clark LLP

(57) ABSTRACT

The present invention relates to a piece of furniture comprising at least one adjustable use portion, in particular an office chair having an adjustable seat and/or an adjustable backrest. The present invention further relates to an adjusting assembly that can be used, for example, for a piece of furniture of said type.

13 Claims, 2 Drawing Sheets

PIECE OF FURNITURE AND ADJUSTING ASSEMBLY, IN PARTICULAR FOR ADJUSTING A BACK OF A CHAIR

The present invention relates to a piece of furniture comprising at least one adjustable use portion, in particular to an office chair comprising an adjustable seat and/or an adjustable backrest. The present invention further relates to an adjusting assembly that can be used, for example, for a piece of furniture of said type.

To be able to adapt furniture to a user's special requirements or to various usage options, one or more use portions of the piece of furniture are typically provided in a movable and adjustable manner, so a user can move them into the desired position as required. This adjustment is mostly carried out by manually actuating a mechanical or pneumatic adjustment device. For example, office chairs are known in which the seat height thereof can be adjusted by actuating a pneumatic spring, and the backrest tilt thereof can be adjusted counter to the force of a mechanical return spring and locked in a desired position. To adjust the use portion, in most cases the user exerts a force in the adjustment direction directly on the use portion, as a result of which the adjustment operation can be completed in a simple and intuitive manner for the user. In the case of an office chair, the option for mechanical adjustment counter to the force of a spring is also advantageous in that a free-rocking function can be provided for the backrest, in which, when the backrest is unlocked, the user can rock forwards and backwards by exerting a pressure on the chair back, this function being conducive to seating comfort.

However, the mechanical adjustment becomes limited when a particular configuration of the piece of furniture is to be fine-adjusted. In the case of an office chair, for example, the user in most cases has to rise up from the seat in order to increase the seat height of the chair. In some cases, the relieving movement for relieving the load on the backrest and unlocking it also takes some getting used to since the spring force in the backrest that is suddenly active upon unlocking can be surprisingly large or surprisingly small for the user, especially with a new chair. Fine adjustment of the back tilt is thus often only possible after a few attempts.

In the field of vertically adjustable tables, electric-motor drives for adjusting the height of the tabletop are already known. In this way, the height of the table can be adjusted relatively precisely and with the push of a button, although with large adjustment paths the adjustment operation can take a long time, according to the speed of the reduction gearing, and the user has the feeling that his influence on the tabletop and the adjustment options for the table are limited to the operation of the electric motor. Some users would, however, prefer rapid and direct manual adjustment of the piece of furniture.

Against this background, the object of the present invention is to provide a piece of furniture that has an adjustable use portion and allows a particular height or tilt of the use portion to be actuated precisely, yet also provides the user with an additional degree of operational freedom, in particular in order to allow the use portion to be manually adjusted rapidly and/or mechanically. The object of the invention is also to provide an adjusting assembly having an electric-motor-driven adjustment device, the adjusting assembly also being intended to have a wider range of uses and applications.

According to a first aspect of the present invention, this object is achieved by a piece of furniture comprising at least one adjustable use portion, the piece of furniture comprising, according to the invention, a drive unit having an electric motor, an adjustment device driven by the drive unit for adjusting a height or tilt of the use portion, and a coupling arranged between the drive unit and the adjustment device, the coupling introducing driving force from the drive unit into the adjustment device when in the closed state and stopping force being transmitted between the drive unit and adjustment device when in the open state.

Therefore, in a piece of furniture according to the invention, the use portion can be adjusted in terms of height and/or tilt by the force from an electric motor. The adjustment by means of electric motor provides high levels of operating comfort since the force to be applied for the adjustment movement is taken on by an electric motor, and the user merely has to activate the drive unit, for example by pushing a button. In addition, the operation of the electric motor means that a desired height or tilt of the use portion can be reached very precisely, and even small adjustments can optionally be made without difficulty. At the same time, however, providing the coupling according to the invention makes it possible to decouple the drive unit and adjustment device from one another as needed, such that the adjustment device can be moved by an alternative actuation. This alternative actuation can, for example, be a manual mechanical adjustment or adjustment by an alternative drive, so it is possible to provide an alternative option for adjusting the use portion.

When the coupling is open, the adjustment device can be manually adjustable, in particular by the user exerting a force on the use portion. The user can then move the use portion into a desired height or tilt by a manual mechanical movement, and is given another functionality or operating option for the piece of furniture, in addition to the adjustment by the electric motor. When the coupling is open, the use portion could in particular be adjusted by the user at a high speed over a large adjustment path, such that the adjustment operation can be made shorter. The options for adjusting the use portion by the alternative actuation when the coupling is open can be the same as the adjustment movements that the electric-motor-driven drive unit performs when the coupling is closed, and so substantially the same ranges of height and/or tilt of the use portion can be achieved with the coupling open. On the other hand, it is also conceivable for the adjustment range of the use portion (range of adjustable heights and tilts of the use portion) to be smaller or larger when the coupling is open than when the coupling is closed. Moreover, it is conceivable for the adjustment ranges for the closed and open coupling to only either meet or be completely separate, such that heights or tilts of the use portion can specifically only be set using the electric-motor drive and other heights or tilts of the use portion can only be reached with the coupling open.

The adjustment device can comprise a resilient spring means that biases the adjustment device in an adjustment direction, at least when the coupling is open. The user is thus given feedback by the use portion, in particular in the case of a manually and mechanically adjustable use portion, and can move the use portion in a first adjustment direction counter to the force of the spring means by exerting an appropriate force, while an adjustment movement automatically takes place in the opposite direction owing to the force of the spring means. The automatic adjustment by means of spring means can also be used to produce a rocking function, for example in a backrest of an office chair.

Preferably, the coupling of the piece of furniture according to the invention comprises a first coupling element, which is associated with the drive unit, and a second coupling element, which is associated with the adjustment device, the first coupling element and the second coupling element being connected for conjoint rotation when the coupling is closed and the first coupling element and the second coupling element being separated when the coupling is open. A coupling of this type can be implemented in a cost-effective and lightweight manner using relatively simple components.

When using a coupling having a first and a second coupling element, the adjustment device can also comprise a force conversion mechanism which exerts a rotational force on the second coupling element when the user exerts an operating force on the use portion, the force conversion mechanism limiting this rotational force to a predefined maximum rotational force. A force conversion mechanism of this type is implemented, for example, by a reduction gear, for example with speed reduction by means of spindle drives or worm drives having appropriate thread pitches. To conserve energy, the initial rotational force is then inevitably reduced in most cases in the transmission direction. The reduction/speed ratio (e.g. the threaded rod) of the force conversion mechanism can thus be designed such that, with realistic operating forces acting on the use portion, the rotational force of the second coupling element can be limited to a maximum rotational force. If, in a preferred embodiment of the present invention, said predefined maximum rotational force is below a turn-over force of the drive unit in the passive state, i.e. below a force required for turning over the deactivated electric motor and any gearing means, this results in the entire system being in a self-locking state when the coupling is closed. Even when there are high operating forces acting on the use portion (for example by gravitational force or pressure from a user), the rotational force generated at the second coupling element is not sufficient to turn over the drive unit in the passive (de-energised) state, and so the adjustment device is locked and the use portion remains fixed in place.

Advantageously, the coupling can thus not only be used for the above purpose for providing an alternative adjustment option, but rather can also simultaneously be used as a locking means for locking a set height or tilt of the use portion.

A simple and technically reliable example of a piece of furniture having a self-locking adjustment system can be produced by the adjustment device comprising a threaded spindle drive which enters a self-locking state when the coupling is closed. A person skilled in the art can provide a threaded spindle drive of this type in a simple manner by providing an appropriate pitch for the thread of the threaded spindle drive. A person skilled in the art ascertains the appropriate pitch of the thread during simple investigations on specific systems by selecting the thread pitch to be small enough for self-locking to become active.

Particularly advantageously, the thread pitch of the threaded spindle drive is also selected such that, when the coupling is open, the threaded spindle is rotated by the user exerting an operating force on the use portion, i.e. the threaded spindle drive does not self-lock. Accordingly, it is possible to manually adjust the use portion when the coupling is open by exerting a suitable operating force directly on the use portion. The threaded spindle drive can then provide, in particular in combination with a resilient spring means described above, which biases the adjustment device in an adjustment direction when the coupling is open, a free-rocking function for a seat or a backrest of an office chair when the coupling is open, the adjustment system becoming self-locked as a result of the closure of the coupling (with the electric motor still in the passive state) and the set position of the office chair being locked.

In another preferred embodiment of the present invention, the coupling can comprise an actuator which moves the coupling between the open position and the closed position on the basis of an electrical signal, the actuator preferably consuming electrical energy substantially only for the operation for switching the coupling between the open and closed position, and the coupling being designed to maintain the set position without consuming electrical energy. Therefore, electrical energy is only required for the adjustment operations: for actuating the coupling and optionally also for actuating the drive unit. At other times, the piece of furniture may not consume any power, and so energy is saved and the piece of furniture is also designed in particular for operation using a rechargeable or non-rechargeable battery. If there is no power supply or the batteries are empty, the set configuration of the piece of furniture is also maintained for the time being; in particular, the coupling is not suddenly or unexpectedly switched, nor is the use portion unexpectedly adjusted.

In a particularly preferred variant of the invention, the piece of furniture is an office chair that comprises: a base, a seat, a chair column that extends in the vertical direction between the base and the seat, and a backrest, the adjustable use portion including the seat and/or the backrest and/or an armrest. Advantageously, the various operating options for adjusting the piece of furniture are particularly apparent with an office chair, since the seat and/or the backrest and possibly other portions of an office chair have to be adapted to the requirements of the user particularly often, and the office chair is also frequently readjusted in order to allow for high levels of seating comfort and to enable the seating position to be changed. Office chairs are often used for many hours a day and have a significant effect on the wellbeing of the user over many parts of their professional life, meaning that improvements to the settings have a great impact in this respect. This relates in particular to the setting of the backrest tilt of an office chair, in which the present invention combines convenient and precise electric-motor setting with the option of rapid manual adjustment. Variants of the invention also provide a free-rocking function for the backrest, as explained above.

In another embodiment of the present invention, the adjustment device is a first adjustment device of a plurality of adjustment devices, and a second adjustment device is also provided for adjusting an additional positional parameter of the use portion and/or for adjusting the height or tilt of an additional use portion of the piece of furniture, a gearing being arranged between the drive unit and the first adjustment device, which gearing is designed to introduce driving force from the drive unit into the second adjustment device such that the two adjustment devices can be driven by a common drive unit. In this embodiment, a plurality of adjustment devices for adjusting a plurality of use portions can be driven by a common drive unit—in an office chair, for example, a first adjustment device for adjusting the backrest and a second adjustment device for adjusting the seat—and so the costs and weight of the piece of furniture can be reduced. In an office chair, the common drive unit and possibly parts of the gearing can, for example, be housed in a vertical chair column or below the seat in a seat shell. An energy source (rechargeable or non-rechargeable battery) can also be located in a chair column and/or below the seat, such that the office chair can be used without cables.

According to a second aspect of the present invention, the aforementioned object is achieved by an adjusting assembly, in particular for a use portion of a piece of furniture, the adjusting assembly comprising a drive unit having an electric motor, an adjustment device driven by the drive unit, and a coupling arranged between the drive unit and the adjustment device, the coupling introducing driving force from the drive unit into the adjustment device when in the closed state and stopping force being transmitted between the drive unit and adjustment device when in the open state, and the coupling comprising a switch element that can be moved by means of magnetic force in order to switch the coupling between the closed state and the open state.

In order to switch the coupling, a magnetically movable switch element is subjected to an accurately definable magnetic force, such that the coupling can be opened and closed particularly reliably. Unlike a coupling that is to be actuated manually by an actuation lever or the like, the switch element can in particular also be adjusted in a contactless manner, which can be particularly advantageous even when the components of the coupling are rotating.

The switch element can be formed by one of two coupling elements, i.e. by a first coupling element associated with the drive unit, or a second coupling unit associated with the adjustment device, the first coupling element and the second coupling element being connected for conjoint rotation when the coupling is closed and the first coupling element and the second coupling element being separated when the coupling is open. In the process, the two coupling elements can each comprise or form a magnet, or can be made of magnetic material in order to interact with a magnet. Depending on the design, both permanent magnets and electromagnets or combinations thereof can be considered for the actuation of the switch element.

The coupling of the adjusting assembly of the second aspect of the invention can comprise an actuator that moves the coupling between the open position and the closed position on the basis of an electrical signal, the actuator preferably consuming electrical energy substantially only for the operation for switching the coupling between the open position and the closed position, and the coupling being designed to maintain the set position without consuming electrical energy. This can be implemented in particular by the switch element or the coupling being held by the force of at least one permanent magnet, which does not consume any electrical energy, when in both the open position and the closed position. To switch between the closed position and the open position, at least one permanent magnet can be moved, or an electromagnet having a corresponding polarity can be activated, as a result of which a switching operation takes place counter to the force of each permanent magnet. It is particularly conceivable for a first permanent magnet to be provided to hold the coupling in the closed position, and for a second permanent magnet to be provided to hold the coupling in the closed position. The actuator can then comprise an electromagnet which generates an electromagnetic field to move the switch element on the basis of the electrical signal.

An adjusting assembly of the second aspect of the present invention is particularly preferably a part of a piece of furniture of the first aspect of the invention, where it is used to adjust the use portion.

The invention will be explained in more detail below on the basis of a preferred embodiment and with reference to the accompanying drawings, in which:

DETAILED DESCRIPTION

Figure 1:
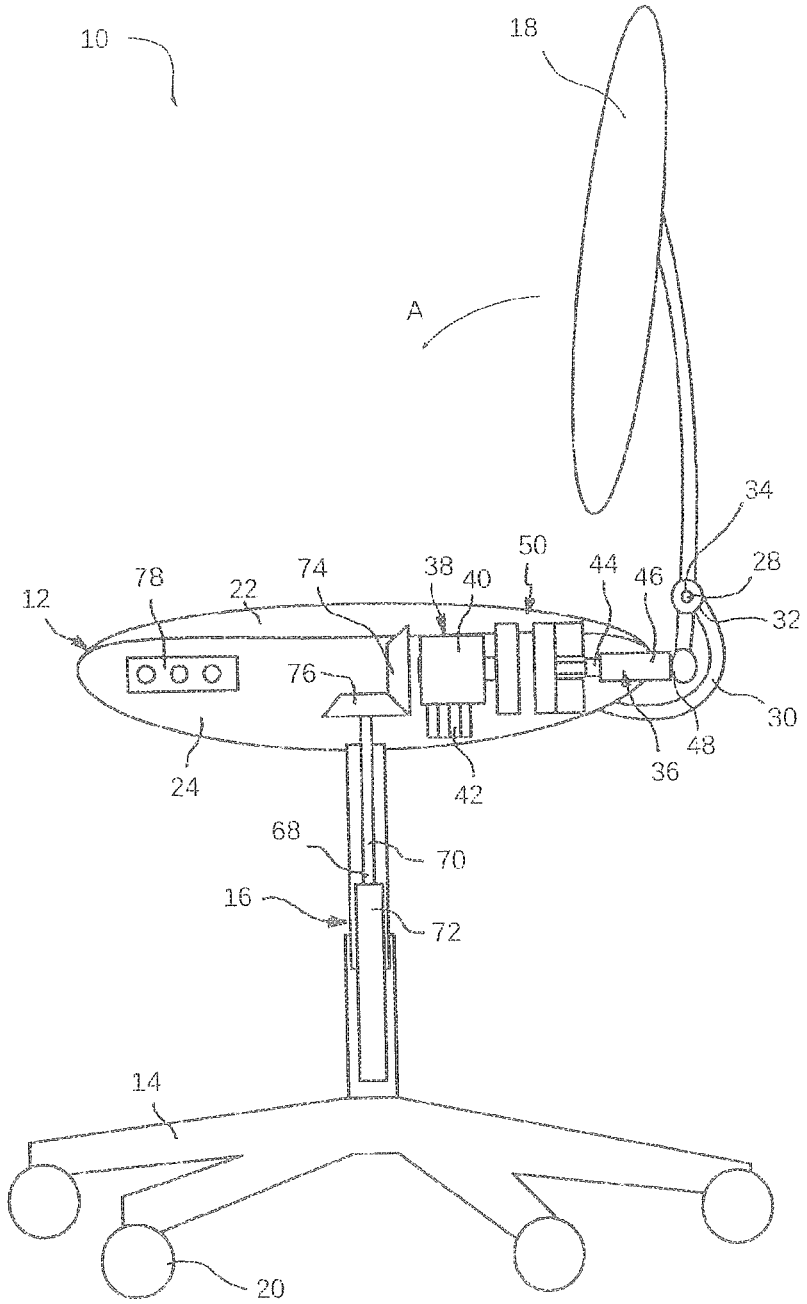
FIG. 1 is a transparent side view of an office chair according to an embodiment of the present invention.

An office chair denoted in general by 10 in FIG. 1 is an embodiment of a piece of furniture according to the present invention, which will be described below in more detail. The office chair 10 comprises a seat 12, a base 14, a chair column 16 extending in the vertical direction between the seat 12 and the base 14, and a backrest 18. As is common for office chairs, the chair column 16 is provided as the single central column for connecting the base 14 and the seat 12. One or more support elements, for example in the form of chair casters 20, can be provided on the base 14 for support against the floor. The seat 12 can have upholstery 22, which can be held on a seat shell 24. The backrest 18 can also have upholstery (not shown). Preferably, the seat 12 is mounted so as to be freely rotatable with respect to the base 14 about the vertical axis of the chair column 16, as is also known per se for office chairs.

The backrest 18 is attached to the seat 12 and held in a pivotable manner on a preferably horizontal pivot pin 28 so as to be able to adjust a tilt of the backrest 18 relative to the seat 12. In the embodiment shown, a bracket 30 that has a hinge portion 32 and is rigidly connected to the seat 12, in particular to the seat shell 24, is provided, on which bracket the pivot pin 28 of the backrest 18 is mounted. A spring element 34 is provided on the pivot pin 28 such that the backrest 18 is biased into an upright position or in a direction towards the seat 12. The spring force direction of the spring element, which is preferably formed as a torsion spring about the pivot pin 28, is indicated in FIG. 1 by an arrow A.

The office chair comprises an adjustment device 36 for adjusting a tilt of the chair back 18, and an electric-motor drive unit 38, which is coupled to the adjustment device 36 such that the backrest 18 can be adjusted by the force of the drive unit. In the process, the drive unit 38 can comprise an electric motor 40 and an energy source 42, which is preferably formed by a rechargeable or non-rechargeable battery. Alternatively, the electric motor can be supplied with energy by a power grid.

The adjustment device 38 comprises a threaded drive assembly having a threaded spindle 44, which comprises an external thread that engages in an internal thread of a threaded cylinder 46. If the threaded spindle 44 and the threaded cylinder 46 are rotated relative to one another by the force of the electric motor 40, the axial length of the threaded drive assembly is lengthened or shortened. This linear actuation movement is transmitted to the backrest 18 via a joint 48, the joint 48 being provided at a distance from the pivot pin 28 such that the linear actuation movement of the threaded drive assembly can be converted into a pivot movement of the backrest 18. To integrate the adjustment device 36 in the region of the seat 12 in an inconspicuous manner, the stop 48 of the backrest 18 is advantageously below the pivot pin 28. Alternative gearing elements are conceivable for converting the actuation movement of the threaded drive assembly into a pivot movement of the backrest, for example by gearwheel transmission, belt or chain transmission, or the like.

According to the invention, a coupling 50 is arranged between the adjustment device 36 and the drive unit 38, which coupling introduces driving force from the drive unit 38, i.e. a rotational force from the electric motor 40, into the adjustment device 36 when in the closed state, i.e. in particular causes one of the two elements out of the threaded spindle 44 and threaded cylinder 46 to rotate relative to the other, whilst transmission of force is stopped between the drive unit 38 and the adjustment device 36 when the coupling is in the open state. The design and action of a preferred example of a coupling 50 of this type will be explained in more detail below with reference to FIGS. 2*a* and 2*b*.

The coupling 50 preferably comprises a first coupling element 52 on the drive side, which is connected for conjoint rotation to an output shaft 54 of the electric motor 40, and a second coupling element 56, which is connected for conjoint rotation to the adjustment device 36. In this embodiment, the adjustment device 36 comprises the threaded drive assembly and the second coupling element 56 is, for example, connected for conjoint rotation to the threaded spindle 44.

Figure 2A:
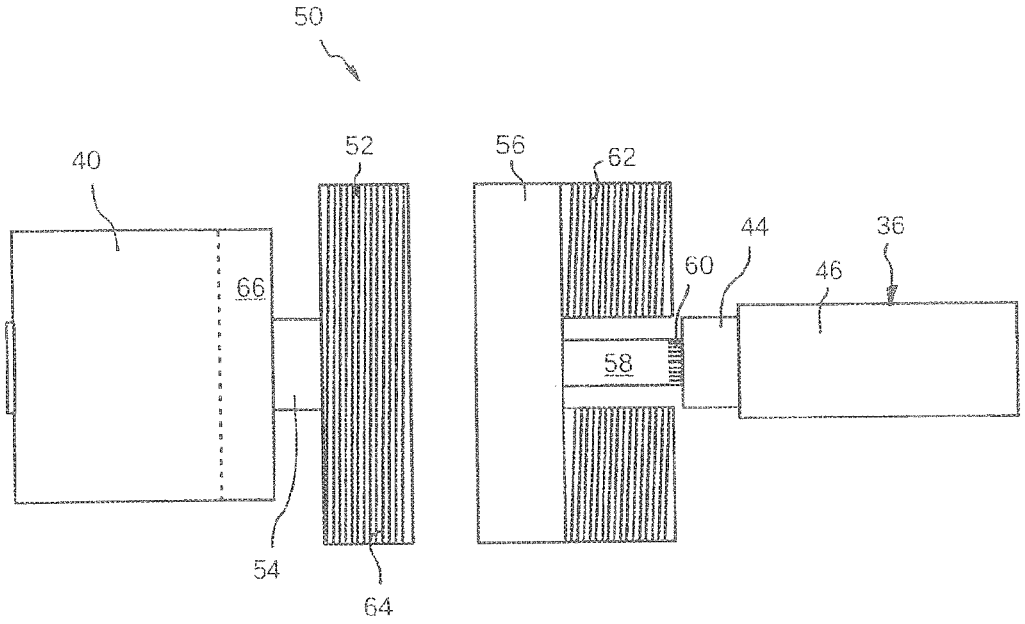
FIGS. 2*a* and 2*b* are functional views of an actuation device of the embodiment of the invention in a position with the coupling open (FIG. 2*a*) and the coupling closed (FIG. 2*b*).
Figure 2B:
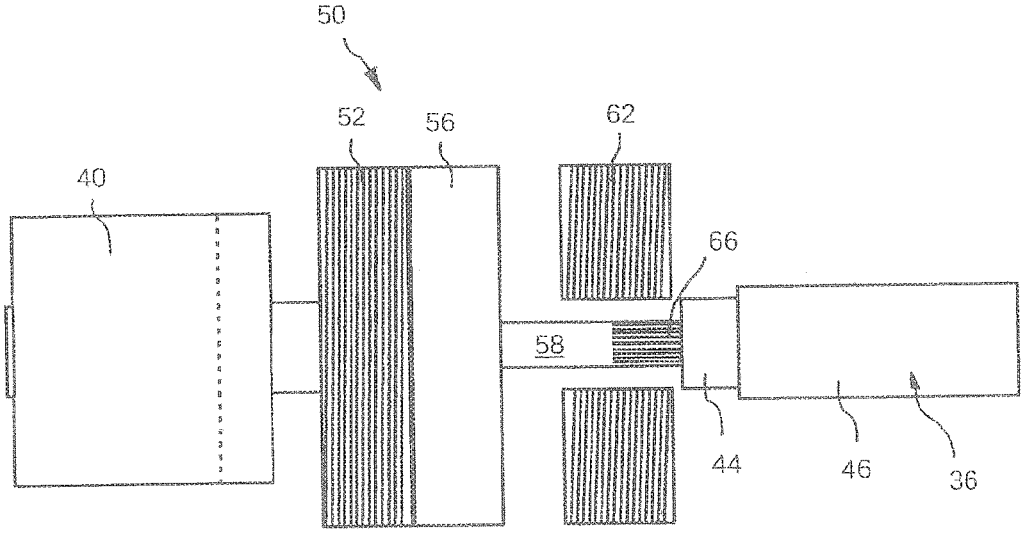

The first coupling element 52 and the second coupling element 56 can be displaced relative to one another in the axial direction of the motor output shaft 54 such that they can be adjusted between a state with the coupling open according to FIG. 2*a*, in which the first coupling element 52 and the second coupling element 56 are spaced apart from one another, so no rotational force is transmitted between the coupling elements 52 and 56, and a state with the coupling closed according to FIG. 2*b*, in which the coupling elements 52, 56 are brought towards one another and connected for conjoint rotation, so rotational force can be transmitted between the coupling elements 52, 56. In the embodiment shown, this adjustability of the coupling 50 is produced, for example, by the second coupling element 56 comprising a pin 58 that has an axial serration 60 which engages in a corresponding serration (not shown) of the threaded spindle 44, and so the second coupling element 56 is coupled to the threaded spindle 44 for conjoint rotation but so as to be axially displaceable. Alternatively, the second coupling element 56 could be mounted on its pin 58 for conjoint rotation but so as to be axially displaceable.

The movement of the second coupling element 56 into the closed state is limited by the second coupling element 56 coming into contact with the first coupling element 52. Movement of the second coupling element 56 in the opposite direction towards the open state is limited by a coupling opening stop 62, which is preferably arranged around the pin 58 of the second coupling element 56 as a coaxial disc. Preferably, the coupling opening stop 62 is arranged so as to be rotatable about the pin 58 together with the second coupling element 56, yet is held so as to be axially immovable relative to the first coupling element 52. When the coupling is open, the second coupling element 56 and the coupling opening stop 52 thus abut one another and rotate together.

In the embodiment shown, the coupling 50 is moved between the open state and closed state by means of magnetic force. For this purpose, the first coupling element 52 preferably comprises a permanent magnet and the coupling opening stop 62 also comprises a permanent magnet. The second coupling element 56 can then be made of a magnetic material, for example a steel, so it is held robustly in both coupling states by the magnetic force of the stop body 52 or 62 in each case. To move the second coupling element 56 out of these positions, an electromagnet 64, for example in the form of a coaxial coil winding, is also provided on the first coupling element 52 and on the coupling opening stop 62. Each of the electromagnets of the first coupling element 52 and of the coupling opening stop 62 can be powered by a power supply device (not shown) and activated in such a way that it generates an electromagnetic field that is directed in the opposite direction to the magnetic field of each permanent magnet, and so the attractive force from this magnet is limited to the second coupling element or is even reversed into a repulsive force. If the second coupling element 56 is in contact with the coupling opening stop 62, for example in the position shown in FIG. 2*a*, and the electromagnet of the coupling opening stop 62 is operated such that it cancels out the field of the permanent magnet of the coupling opening stop 62, the second coupling element 56 lifts off the coupling opening stop 62 under the action of the attractive force of the permanent magnet of the first coupling element 52 and moves towards the first coupling element 52 until it comes into contact with said element and the coupling passes into the closed state according to FIG. 2*b*. Alternatively or additionally, this movement can be caused or supported by the electromagnet 64 of the first coupling element 52 being actuated accordingly and/or can be caused or assisted by the electromagnet of the coupling opening stop 62 being energised accordingly strongly in the sense of repelling the second coupling element 56.

To switch the coupling 50 from the closed position into the open position, on the other hand, the electromagnet 64 of the first coupling element 52 can be activated such that the electromagnetic field thereof cancels out the magnetic field of the permanent magnet of the first coupling element 52, and so the second coupling element 56 is moved towards the coupling opening stop 62 by the force of the permanent magnet of the coupling opening stop 62 (and/or possibly by a force of the appropriately wired electromagnet of the coupling opening stop 62).

After each switching operation, the energy supply to the electromagnets can be switched off, and the second coupling element 56 remains in the set coupling position owing to the force of the respective permanent magnet, meaning that electrical energy only has to be expended for the switching operation. The electrical energy can be provided by the energy source 42 that also powers the electric motor 40.

Regardless of the specific design of the coupling 50, the decoupling according to the invention of the drive unit 38 and the adjustment device 36 enables a free-rocking function in the backrest 18. For this purpose, a thread pitch of the threaded spindle 44 or threaded cylinder 46 is selected such that, in a state with the coupling open (FIG. 2*a*), the second coupling element 56 is rotated when a force is exerted on the backrest 18 by the user in a direction counter to the arrow A and the threaded drive assembly is thus compressed, and in the process the coupling opening stop 62 in particular also rotates therewith. The thread pitch is also selected such that, when the backrest 18 is relieved of load, the force of the spring element 34 is sufficient to extend the threaded drive assembly, rotating the second coupling element 56 accordingly. When the coupling 50 is open, the backrest 18 can thus be manually pivoted backwards and forwards.

If, on the other hand, the coupling 50 is closed, a rotational force of the second coupling element 56, caused by the user actuating the backrest 18 or by the spring element 34, is introduced into the electric motor 40 via the coupling 50. When the electric motor is switched off (passive drive unit), the electric motor 40 opposes a rotation introduced therein by a predefined turn-over force. Advantageously, the thread pitch of the threaded drive assembly 44, 46 is now selected such that, when force is input into the backrest 18 by the user or by the spring element 34, and specifically with the coupling 50 open, the second coupling element 56 is rotated and thus the backrest 18 is adjusted.

However, when the coupling 50 is closed, the rotational force acting on the second coupling element 56 is smaller than the turn-over force of the electric motor 40, and so the rotation is blocked and in particular so too is adjustment of the threaded drive assembly 44, 46 and thus adjustment of the backrest 18. This state is referred to as self-locking, caused by the gearing speed reduction of the threaded assembly between the threaded spindle 44 and the threaded cylinder 46. A person skilled in the art would ascertain the suitable thread pitch for a particular specific adjustment system in a simple manner, for example by simple investigations by reducing the pitch of the thread of the threaded drive assembly 44, 46 in steps, starting from a very steep thread (high pitch), in which adjustment of the backrest 18 by the user exerting a manual force leads to the motor 40 turning over when the coupling is closed, until adjustment of the backrest 18 can no longer be adjusted or can only be adjusted by exerting an unusually high force on the backrest 18. As a measurement for ascertaining the suitable thread pitch, the automatic adjustment owing to the spring element 34 can also be applied. Therefore, when the coupling is open, free rocking is possible against the force of the spring element 34, while locking occurs when the coupling is closed and adjustment of the backrest 18 requires actuation of the electric motor.

It should be noted at this juncture that the motor 40 can comprise an additional gearing 66, which reduces or increases the speed of the motor to a speed of the output shaft 54. The gearing 66 can in particular also influence the turn-over force of the motor 40. Even though the gearing 66 can also be provided to be largely separate from a stator of the motor 40, it may be considered to be a part of the motor 40 for illustrative purposes in the context of the present application.

It can also be seen in FIG. 1 that, in addition to the adjustment device 36 of the backrest 18, the drive unit 38 can also drive a second adjustment device 68 for adjusting a height of the seat 12 over the base 14. The second adjustment device 68 can also comprise a threaded drive assembly having a threaded spindle 70 and a threaded cylinder 72, it being possible for the threaded drive assembly to be inserted into the chair column 16 coaxially in the vertical direction such that rotation of the threaded spindle 70 into or out of the threaded cylinder 72 leads to compression or expansion of the threaded drive assembly and thus to the height of the seat 12 being adjusted. The rotational force necessary for adjusting the threaded drive assembly 70, 72 can be introduced from the electric motor 40 into the second adjustment device 68 via a bevel gear transmission, in order to make an angle possible between the axes of rotation of the first adjustment device 36 and the second adjustment device 68. For this purpose, a first bevel gear 74 can be drivable by the electric motor 40 and can mesh with a second bevel gear 76, which is connected to the threaded spindle 70 or the threaded cylinder 72 for conjoint rotation.

Furthermore, a change gear may also be provided for alternately and optionally transmitting the force of the motor 40 to the first adjustment device 36 to adjust the backrest 18 or to the second adjustment device 68 to adjust the seat height. In a simple variant of a change gear of this type, the output shaft 54 of the electric motor can be displaceable in the axial direction, and can be engaged, via an axial serration (not shown), with either the first coupling element 52 or the first bevel gear 74 for conjoint rotation but so as to be axially displaceable. To adjust the backrest 18, the motor output shaft 54 is then, for example, inserted into an axially toothed central opening in the coupling element 52 in order to rotationally drive the first coupling element 52, while the motor output shaft 54 is then retracted from the first bevel gear 74. The electric motor 40 then only drives the adjustment device 36 of the backrest 18. Conversely, the motor output shaft 54 can be displaced axially into an opening in the bevel gear 74 provided with a corresponding axial toothing, such that said shaft drives the first bevel gear 74 and thus the second adjustment device 68 in order to adjust the height of the seat 12, while the motor output shaft is then disengaged from the first coupling element 52 and thus does not rotationally drive the first coupling element 52.

As can be seen in FIG. 1, the drive unit 38 (optionally including batteries 42), the coupling 50 and important parts of the adjustment device 36 and change gear can be housed in the seat 12 of the office chair 10, and so effective use is made of the space therein. At the same time, an essential part of the adjustment device 68 can advantageously be housed in the chair column 16.

An operating unit 78 can also be provided on the seat 12 or on another element of the office chair 10, or can be provided separately from the office chair 10 and connected by means of cables or wireless communication, which unit converts manual inputs from the user into corresponding control signals for actuating the drive unit 38, the coupling 50 and optionally the change gear. The operating unit 78 can be formed by a smartphone on which a suitable program code is stored for transmitting control signals to a wireless receiver unit (not shown) of the office chair 10, the drive unit 38 and/or the coupling 50 being actuated on the basis of signals received by the wireless receiver unit from the smartphone.

The invention claimed is:

1. Piece of furniture comprising at least one adjustable use portion having a drive unit comprising an electric motor, an adjustment device driven by the drive unit for adjusting a height or tilt of the use portion, and a coupling arranged between the drive unit and the adjustment device, which coupling introduces driving force from the drive unit into the adjustment device when in a closed state and stops force being transmitted between the drive unit and adjustment device when in an open state, wherein the coupling comprises a first coupling element, which is associated with the drive unit, and a second coupling element, which is associated with the adjustment device, the first coupling element and the second coupling element being connected for conjoint rotation when the coupling is closed and the first coupling element and the second coupling element being separated when the coupling is open.

2. Piece of furniture according to claim 1, wherein, when the coupling is open, the adjustment device can be adjusted manually by exerting a force on the use portion.

3. Piece of furniture according to claim 1, wherein the adjustment device comprises a resilient spring means which biases the adjustment device in an adjustment direction, at least when the coupling is open.

4. Piece of furniture according to claim 1, wherein the adjustment device comprises a force conversion mechanism which exerts a rotational force on the second coupling element when the user exerts an operating force on the use portion, the force conversion mechanism limiting this rotational force to a predefined maximum rotational force, and the predefined maximum rotational force being smaller than a turn-over force of the drive unit in the passive state.

5. Piece of furniture according to claim 4, wherein the adjustment device comprises a threaded spindle drive which is rotated when the coupling is open by the user exerting an operating force on the use portion and which enters a self-locking state when the coupling is closed.

6. Piece of furniture according to claim 1, wherein the coupling comprises an actuator that moves the coupling between the open position and closed position on the basis of an electrical signal, the actuator preferably consuming electrical energy substantially only for the operation for switching the coupling between the open position and the closed position, and the coupling being designed to maintain set position without consuming electrical energy.

7. Piece of furniture according to claim 1, wherein the piece of furniture is an office chair that comprises:

a base, a seat, a chair column that extends in the vertical direction between the base and the seat, and a backrest, and the adjustable use portion including the seat and/or the backrest and/or an armrest.

8. Piece of furniture according to claim 1, wherein the adjustment device is a first adjustment device of a plurality of adjustment devices, and in that a second adjustment device is also provided for adjusting an additional positional parameter of the use portion and/or for adjusting the height or tilt of an additional use portion of the piece of furniture, a gearing being arranged between the drive unit and the first adjustment device, which gearing is designed to introduce driving force from the drive unit into the second adjustment device such that the two adjustment devices can be driven by a common drive unit.

9. Adjusting assembly for a use portion of a piece of furniture, comprising:

a drive unit having an electric motor, an adjustment device driven by the drive unit, and a coupling arranged between the drive unit and the adjustment device, which coupling introduces driving force from the drive unit into the adjustment device when in a closed state and stops force being transmitted between the drive unit and adjustment device when in an open state, wherein the coupling comprises a switch element that can be moved by means of magnetic force in order to switch the coupling between the closed state and the open state, wherein the coupling comprises a first coupling element, which is associated with the drive unit, and a second coupling element, which is associated with the adjustment device, the first coupling element and the second coupling element being connected for conjoint rotation when the coupling is closed, and the first coupling element and the second coupling element being separated when the coupling is open, and the switch element being formed by the first or second coupling element.

10. Adjusting assembly according to claim 9, wherein the coupling comprises an actuator that moves the coupling between the open position and the closed position on the basis of an electrical signal, the actuator preferably consuming electrical energy substantially only for the operation for switching the coupling between the open position and the closed position, and the coupling being designed to maintain set position without consuming electrical energy.

11. Adjusting assembly according to claim 10, wherein the actuator comprises an electromagnet, which generates an electromagnetic field for moving the switch element on the basis of the electrical signal.

12. Adjusting assembly according to claim 9, wherein the coupling is held in the open position or in the closed position by the force of at least one permanent magnet, in particular a first permanent magnet being provided to hold the coupling in the closed position, and a second permanent magnet being provided to hold the coupling in the open position.

13. Piece of furniture, comprising an adjusting assembly including at least one adjustable use portion having a drive unit comprising an electric motor, an adjustment device driven by the drive unit for adjusting a height or tilt of the use portion, and a coupling arranged between the drive unit and the adjustment device, which coupling introduces driving force from the drive unit into the adjustment device when in a closed state and stops force being transmitted between the drive unit and adjustment device when in an open state, wherein the coupling comprises a switch element that can be moved by means of magnetic force in order to switch the coupling between the closed state and the open state, wherein the coupling comprises a first coupling element, which is associated with the drive unit, and a second coupling element, which is associated with the adjustment device, the first coupling element and the second coupling element being connected for conjoint rotation when the coupling is closed, and the first coupling element and the second coupling element being separated when the coupling is open, and the switch element being formed by the first or second coupling element.

* * * * *